US011913100B2

(12) United States Patent
Kawano

(10) Patent No.: US 11,913,100 B2
(45) **Date of Patent: *Feb. 27, 2024**

(54) STEEL FOR A MOLD

(71) Applicant: DAIDO STEEL CO., LTD., Nagoya (JP)

(72) Inventor: Masamichi Kawano, Nagoya (JP)

(73) Assignee: DAIDO STEEL CO., LTD., Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/529,849

(22) Filed: Nov. 18, 2021

(65) Prior Publication Data

US 2022/0162732 A1 May 26, 2022

(30) Foreign Application Priority Data

Nov. 25, 2020 (JP) ..... 2020-195052

(51) Int. Cl.

| | |
|---|---|
| ***C22C 38/00*** | (2006.01) |
| ***C22C 38/52*** | (2006.01) |
| ***C22C 38/02*** | (2006.01) |
| ***C22C 38/04*** | (2006.01) |
| ***C22C 38/06*** | (2006.01) |

(Continued)

(52) U.S. Cl.

CPC ..... *C22C 38/52* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01)

(58) Field of Classification Search

None

See application file for complete search history.

(56) References Cited

U.S. PATENT DOCUMENTS 11,377,718 B2 * 7/2022 Kawano ..... C22C 38/50
2020/0115783 A1 4/2020 Kawano

FOREIGN PATENT DOCUMENTS

CN 101660098 A 3/2010
CN 102321850 A 1/2012

(Continued)

OTHER PUBLICATIONS

Chinese Office Action, dated Aug. 18, 2022, in Chinese Application No. 202111410587.X and English Translation thereof.

(Continued)

*Primary Examiner* — Humera N. Sheikh
*Assistant Examiner* — Kim S. Horger
(74) *Attorney, Agent, or Firm* — MCGINN I.P. LAW GROUP, PLLC

(57) ABSTRACT

The present invention relates to a steel for a mold, including 0.070≤C≤0.130 mass %, 0.01≤Si≤0.60 mass %, 0.02≤Mn≤0.60 mass %, 0.003≤P≤0.150 mass %, 0.005≤Cu≤1.50 mass %, 0.005≤Ni≤0.80 mass %, 7.50≤Cr≤8.40 mass %, 0.70≤Mo≤1.20 mass %, 0.01≤V≤0.30 mass %, 0.010≤Al≤0.120 mass %, and 0.015≤N≤0.095 mass %, with the balance being Fe and unavoidable impurities. The steel for a mold according to the present invention satisfies all of 6 properties of SA property, tempering hardness, residual stress, machinability, impact value and corrosion resistance.

18 Claims, 3 Drawing Sheets

(51) Int. Cl.

| | |
|---|---|
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(56) References Cited

FOREIGN PATENT DOCUMENTS

| | | | | |
|---|---|---|---|---|
| CN | 102527956 | A | | 7/2012 |
| CN | 102581555 | A | | 7/2012 |
| EP | 2 218 802 | A1 | | 8/2010 |
| EP | 2 915 895 | A2 | | 9/2015 |
| JP | H11350031 | A | * | 6/1998 |
| JP | 5239578 | B2 | | 7/2013 |
| JP | 2013-177669 | A | | 9/2013 |
| JP | 2013177669 | A | * | 9/2013 |
| JP | 2015-081356 | A | | 4/2015 |
| JP | 2020-063508 | A | | 4/2020 |

OTHER PUBLICATIONS

Extended European Search Report dated May 13, 2022 for European Patent Application No. 21210211.5-1103.

* cited by examiner

STEEL FOR A MOLD

TECHNICAL FIELD

The present invention relates to a steel for a mold. More specifically, the present invention relates to a steel for a mold (particularly, a pre-hardened steel thermally refined to a predetermined hardness by performing quenching-tempering under predetermined conditions) for manufacturing a mold to be used in injection molding or blow molding of plastics or in molding or processing, etc. of rubber or various carbon fiber-reinforced plastics.

BACKGROUND ART

The pre-hardened steel indicates a steel thermally refined to a predetermined hardness and capable of being cut and machined. The pre-hardened steel does not require a heat treatment and, after cutting machining, can be directly used as a mold or mold parts. Therefore, the pre-hardened steel is frequently employed for a mold to be used in injection molding or blow molding of plastics or in molding or processing, etc. of rubber or fiber-reinforced plastics (e.g., FRP, CFRP, CFRTP, GFRP), parts to be assembled to a mold, and the like. With respect to such a pre-hardened steel and a manufacturing method thereof, various proposals have been heretofore made.

For example, Patent Literature 1 discloses a steel for a mold for molding plastics, having excellent temperature controllability, and including, in mass %, C: from 0.03% to 0.25%, Si: from 0.01% to 0.40%, Mn: from 0.10% to 1.50%, P: 0.30%, S: 0.050%, Cu: from 0.05% to 0.20%, Ni: from 0.05% to 1.50%, Cr: from 5.0% to 10.0%, Mo: from 0.10% to 2.00%, V: from 0.01% to 0.10%, N: ≤0.10%, O: ≤0.01%, and Al≤0.05%, while satisfying (Cr+Mo)≤10% and 7≤(Cr+3.3Mo), with the balance being Fe and unavoidable impurities.

In this literature, it is stated (a) that by adjusting the mutual ratios of ferrite generating elements (Cr, Mo) and austenite generating elements (Mn, Ni), both a specularity and an impact value can be satisfied and (b) that when the contents of Cr and Mo are optimized to satisfy a predetermined relationship, corrosion resistance and thermal conductivity are increased.

Patent Literature 2 discloses a steel for a mold, including, in mass %, 0.045≤C≤0.090, 0.01≤Si≤0.50, 0.10≤Mn≤0.60, 0.80≤Ni≤1.10, 6.60≤Cr≤8.60, 0.01≤Mo≤0.70, 0.001≤V≤0.200, 0.007≤Al≤0.150, and 0.0002≤N≤0.0500, with the balance being Fe and unavoidable impurities.

In this literature, it is stated that in a steel for a mold containing predetermined elements, when an Al amount is set to a range of 0.007 to 0.150%, after thermally refined to a predetermined hardness, good mirror polishability, intermediate corrosion resistance between a 5% Cr steel and a 12% Cr steel, and high impact value can be realized.

In the case of manufacturing a mold by using a pre-hardened steel, first, a pre-hardened steel material for a mold needs to be manufactured. The pre-hardened steel material for a mold is generally manufactured through respective steps of melting, refining, casting, homogenization heat treatment, hot working, intermediate heat treatment (normalizing, tempering), Spheroidizing Annealing (SA), quenching, straightening, and tempering.

Incidentally, depending on kinds of steels, SA may not be necessary, tempering may be performed a plurality of times, or a tempering step may be provided before and after straightening. Irrespective of the number of times of tempering, the final tempering step is responsible also for reducing the residual stress.

Next, a mold or mold parts are manufactured from the pre-hardened steel material. The mold or mold parts are generally manufactured through respective steps of machining, mirror polishing, surface decoration, and surface treatment.

Here, the surface decoration is a step of giving a specific pattern to the surface by embossing, etc. but may not be necessary depending on use. Also, the surface treatment is a step of hardening the surface by nitridation or PVD, etc. but may not be necessary depending on use.

Important properties required for the pre-hardened steel material manufactured through the above-described steps as well as for a mold and mold parts manufactured using the steel material include the following 6 properties:

(1) SA property (easiness of spheroidizing annealing), (2) tempering hardness (appropriate tempering hardness capable of achieving both high wear resistance and high impact value), (3) residual stress (residual stress low enough to avoid warpage or twisting of the mold), (4) machinability (easiness of cutting machining), (5) impact value (impact value high enough to avoid gross cracking in the mold), and (6) corrosion resistance (corrosion resistance high enough to prevent rusting even when used in a humid environment).

Furthermore, the pre-hardened steel material may be required to be excellent in mirror polishability, emboss processability and/or thermal conductive property, in addition to the above-described 6 properties.

However, there is not in the past a case of proposing a steel material satisfying all of the above-described 6 properties. Also, there is not in the past a case of proposing a steel material excellent in mirror polishability, emboss processability and/or thermal conductive property, in addition to the above-described 6 properties.

For example, P21 steel or a high-Ni martensitic stainless steel has poor SA property. A steel tempered at 510° C. or less has high residual stress. A martensitic stainless steel has poor machinability. P21 steel or a martensitic stainless steel has a low impact value. A steel with a Cr amount of 6% or less has poor corrosion resistance in a humid environment. Furthermore, a steel having significant segregation, a steel allowing for the presence of many hard non-metallic inclusions such as alumina, or a steel containing a large amount of free-cutting elements has poor mirror polishability or emboss processability.

Patent Literature 1: Japanese Patent No. 5239578

Patent Literature 2: JP-A-2020-063508 (the term "JP-A" as used herein means an "unexamined published Japanese patent application")

SUMMARY OF INVENTION

An object of the present invention is to provide a steel for a mold, which satisfies all of 6 properties of SA property, tempering hardness, residual stress, machinability, impact value and corrosion resistance.

Another object of the present invention is to provide a steel for a mold, which is excellent in mirror surface workability, emboss processability and/or thermal conductive property, in addition to the above-described 6 properties.

Namely, the present invention relates to the following configurations (1) to (6):

(1) A steel for a mold, including:

$0.070 \leq C \leq 0.130$ mass %,
$0.01 \leq Si \leq 0.60$ mass %,
$0.02 \leq Mn \leq 0.60$ mass %,
$0.003 \leq P \leq 0.150$ mass %,
$0.005 \leq Cu \leq 1.50$ mass %,
$0.005 \leq Ni < 0.80$ mass %,
$7.50 \leq Cr \leq 8.40$ mass %,
$0.70 < Mo \leq 1.20$ mass %,
$0.01 \leq V \leq 0.30$ mass %,
$0.010 \leq Al \leq 0.120$ mass %, and
$0.015 \leq N \leq 0.095$ mass %, with the balance being Fe and unavoidable impurities.

(2) The steel for a mold according to (1), further including at least one element selected from the group consisting of:

$0.30 < W \leq 4.00$ mass %, and
$0.30 < Co \leq 3.00$ mass %.

(3) The steel for a mold according to (1) or (2), further including:

$0.0002 < B \leq 0.0080$ mass %.

(4) The steel for a mold according to any one of (1) to (3), further including at least one element selected from the group consisting of:

$0.004 < Nb \leq 0.100$ mass %,
$0.004 < Ta \leq 0.100$ mass %,
$0.004 < Ti \leq 0.100$ mass %, and
$0.004 < Zr \leq 0.100$ mass %.

(5) The steel for a mold according to any one of (1) to (4), further including at least one element selected from the group consisting of:

$0.003 < S \leq 0.250$ mass %,
$0.0005 < Ca \leq 0.2000$ mass %,
$0.03 < Se \leq 0.50$ mass %,
$0.005 < Te \leq 0.100$ mass %,
$0.01 < Bi \leq 0.50$ mass %, and
$0.03 < Pb \leq 0.50$ mass %.

(6) The steel for a mold according to any one of (1) to (5), in which the steel has a hardness measured in a temperature range of 15° C. or more and 35° C. or less of 32 HRC or more and 44 HRC or less, and an average absorbed energy measured in a temperature range of 15° C. or more and 35° C. or less of 20 J or more.

In the steel for a mold according to the present invention, components (particularly, Ni, Mo and Al) are optimized and therefore, all of 6 properties of SA property, tempering hardness, residual stress, machinability, impact value and corrosion resistance are satisfied. Specifically, in the steel for a mold according to the present invention, (a) the SA property is higher than that of P21 steel or a high-Ni martensitic stainless steel, (b) the hardness after tempering is an appropriate value of 32 to 44 HRC, (c) the residual stress after tempering is low, (d) the machinability after tempering is higher than that of a martensitic stainless steel, (e) the impact value after tempering is higher than that of P21 steel or a martensitic stainless steel, and (f) the corrosion resistance after tempering, in a humid environment, is higher than that of P21 steel and is as high as that of a martensitic stainless steel.

Accordingly, the steel for a mold according to the present invention is advantageous in that (A) the production cost is lower than that for the conventional steel, (B) deformation during mold processing is very small, making mold processing easy, (C) the mold surface can be polished clean, (D) a crack or rust is less likely to occur during use, and (E) the steel is resistant to rust even at the time of storage during non-use period.

Furthermore, the steel for a mold according to the present invention has excellent mirror surface workability and emboss processability and is higher in the thermal conductivity than a martensitic stainless steel in addition to the above-described 6 properties.

DESCRIPTION OF EMBODIMENTS

Figure 1:
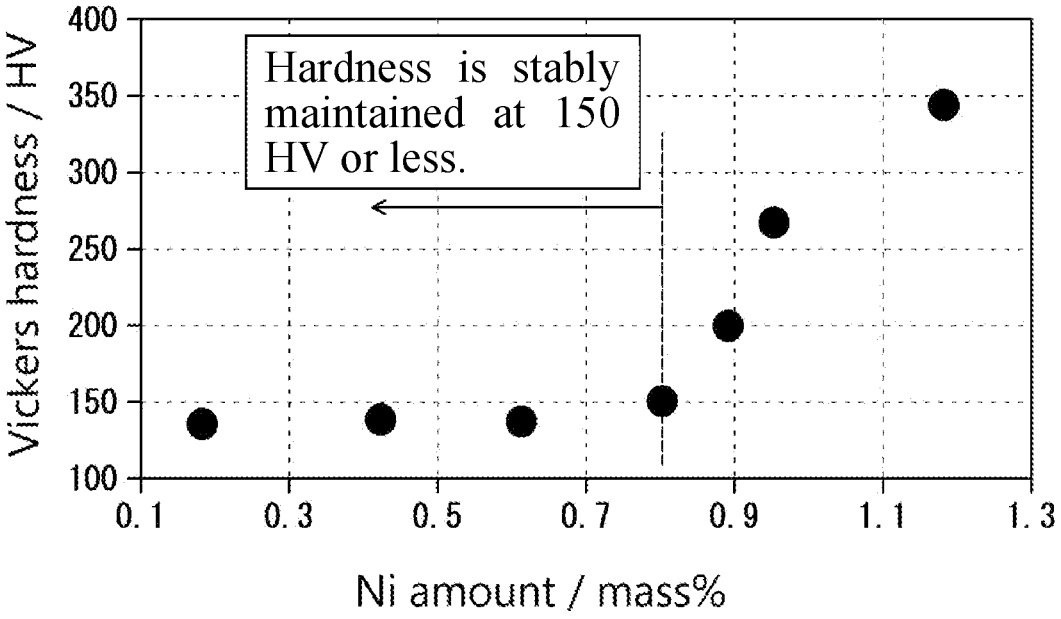
FIG. 1 is a diagram illustrating the effect of Ni amount on the hardness after SA.

One embodiment of the present invention is described in detail below.

[1. Steel for Mold]

[1.1. Composition]

[1.1.1 Main Constituent Elements (Essential Components)]

The steel for a mold according to the present invention includes the following elements, with the balance being Fe and unavoidable impurities. The type of element added, the component range thereof, and the reason for limiting the range are as follows.

(1) $0.070 \leq C \leq 0.130$ Mass %:

When the C amount is in the range described above, even if the steel is tempered at a temperature exceeding 510° C. so as to reduce the residual stress, a hardness of 32 to 44 HRC is obtained. Details of the reason for limiting the range are as follows.

If the C content is too small, ferrite is likely to be present at the time of homogenization heat treatment before hot working. The purpose of the homogenization heat treatment is to form an austenite single phase at a high temperature and homogenize (reduce segregation) the elemental distribution. Reduction of segregation is indispensable for enhancing the mirror polishability or emboss processability. If ferrite is present at the time of homogenization heat treatment, reduction of segregation is difficult. The reason therefor is that austenite and ferrite differ in the type, amount and/or diffusion rate of solid-solution elements.

Also, if the C amount is too small, the number of carbides (carbide serving as a starting point of spheroidization) dispersed in the matrix decreases at the time of SA. Consequently, the carbide is less likely to be spheroidized, and the SA property deteriorates. Furthermore, as the C amount is decreased, the tempering hardness is lowered. Therefore, in order to obtain a hardness of 32 to 44 HRC, the tempering temperature must be set to 510° C. or less, as a result, the residual stress increases.

For this reason, the C amount needs to be 0.070 mass % or more. The C amount is preferably 0.075 mass % or more, more preferably 0.080 mass % or more.

On the other hand, if the C amount is excessive, many Cr are consumed in the formation of carbide, as a result, the amount of solid-solution Cr decreases, and in turn, the corrosion resistance is lowered. Also, cracking readily occurs at the time of weld repair. Furthermore, if the C amount is excessive, reduction in the thermal conductivity is large.

For this reason, the C amount needs to be 0.130 mass % or less. The C amount is preferably 0.125 mass % or less, more preferably 0.120 mass % or less.

In the injection molding of a resin, a resin filled into a mold needs to be solidified quickly so as to enhance the productivity. Therefore, the mold is required to cool fast, that is, have high thermal conductivity. Also, in the case of controlling (heating or cooling) the mold temperature by selectively flowing a high-temperature fluid or a low-temperature fluid into a flow path in the mold, the mold is required to have high response to heating or cooling. From this viewpoint as well, the high thermal conductivity is important. In the steel for a mold according to the present invention, since the Cr amount is as large as about 8%, the thermal conductivity is lower than that of P20 steel or P21 steel. Nevertheless, it is desirable to achieve as high thermal conductivity as possible. The steel for a mold according to the present invention realizes higher thermal conductivity than that of the martensitic stainless steel.

(2) 0.01≤Si≤0.60 Mass %:

When the Si amount is in the range described above, both good machinability and high thermal conductivity can be achieved. Details of the reason for limiting the range are as follows.

In order to extremely reduce the Si amount, an expensive raw material having a very small Si amount must be used, and the material cost rises. Also, an appropriate amount of Si contained in the steel is effective in preventing wear of a tool. Therefore, if the Si amount is too small, the machinability significantly deteriorates.

For this reason, the Si amount needs to be 0.01 mass % or more. The Si amount is preferably 0.05 mass % or more, more preferably 0.10 mass % or more.

On the other hand, if the Si amount is excessive, ferrite is likely to be present at the time of homogenization heat treatment before hot working. Also, in the hot working, a hard and persistent oxide scale is formed on the steel material surface and causes significant wear to a working tool. Furthermore, if the Si amount is excessive, reduction in the thermal conductivity increases.

For this reason, the Si amount needs to be 0.60 mass % or less. The Si amount is preferably 0.55 mass % or less, more preferably 0.50 mass % or less.

(3) 0.02≤Mn≤0.60 Mass %:

When the Mn amount is in the range described above, both high quenchability and good SA property can be achieved. Details of the reason for limiting the range are as follows.

In order to extremely reduce the Mn amount, an expensive raw material having a very small Mn amount must be used, and the material cost rises. Also, if the Mn amount is too much small, ferrite is likely to be present at the time of homogenization heat treatment before hot working. Furthermore, the quenchability lacks, and the impact value inside a pre-hardened steel material having a large cross-section decreases.

For this reason, the Mn amount needs to be 0.02 mass % or more. The Mn amount is preferably 0.05 mass % or more, more preferably 0.10 mass % or more.

On the other hand, if the Mn amount is excessive, significant segregation occurs. In addition, not only the SA property deteriorates but also the thermal conductivity considerably decreases.

For this reason, the Mn amount needs to be 0.60 mass % or less. The Mn amount is preferably 0.55 mass % or less, more preferably 0.50 mass % or less.

(4) 0.003≤P≤0.150 Mass %:

When the P amount is in the range described above, high impact value and high machinability can be realized at low cost. Details of the reason for limiting the range are as follows.

In order to extremely reduce the P amount, an expensive raw material having a very small P amount must be used, and the material cost rises. Also, P has an action of finely crushing cutting chips. Therefore, if the P amount is too small, the machinability deteriorates.

For this reason, the P amount needs to be 0.003 mass % or more. The P amount is preferably 0.005 mass % or more, more preferably 0.007 mass % or more.

On the other hand, if the P amount is excessive, the impact value significantly decreases. Therefore, the P amount needs to be 0.150 mass % or less. The P amount is preferably 0.130 mass % or less, more preferably 0.110 mass % or less.

In the steel (ultralow C-8Cr) for a mold according to the present invention, the impact value is very high, so that even if the P amount is large compared with conventional steel, a high impact value can be ensured. Therefore, even when the P amount is large compared with conventional steel, both high impact value and high machinability can be achieved. In addition, since an inexpensive raw material having a large P amount can be used, an increase in the material cost can also be suppressed.

(5) 0.005≤Cu≤1.50 Mass %:

In order to extremely reduce the Cu amount, an expensive raw material having a very small Cu amount must be used, and the material cost rises. Also, if the Cu amount is too small, ferrite is likely to be present at the time of homogenization heat treatment before hot working. Furthermore, in the case of performing tempering in a high temperature range (temperature range exceeding 510° C.) for the purpose of reducing the residual stress, it is difficult to obtain a hardness of 32 HRC or more. This tendency is prominent when the solid-solution element amount is small, the carbide size is large, and the carbide amount is small. Moreover, if the Cu amount is too small, the machinability and corrosion resistance are reduced.

For this reason, the Cu amount needs to be 0.005 mass % or more. The Cu amount is preferably 0.01 mass % or more, more preferably 0.02 mass % or more.

On the other hand, if the Cu amount is excessive, the material cost rises. In addition, segregation is actualized. Furthermore, the SA property deteriorates, and the thermal conductivity and impact value are also reduced.

For this reason, the Cu amount needs to be 1.50 mass % or less. The Cu amount is preferably 1.40 mass % or less, more preferably 1.30 mass % or less.

Especially, in the case of setting the C amount to 0.120 mass % or less with an emphasis on the corrosion resistance, when the Cu amount is set to be more than 0.20 mass % and 1.30 mass % or less, the balance among machinability, impact value and corrosion resistance is greatly improved.

(6) 0.005≤Ni<0.80 Mass %:

If the Ni amount is too small, ferrite is likely to be present at the time of homogenization heat treatment before hot working. In addition, the quenchability lacks, and the impact value inside a pre-hardened steel material having a large cross-section decreases.

For this reason, the Ni amount needs to be 0.005 mass % or more. The Ni amount is preferably 0.008 mass % or more, more preferably 0.01 mass % or more.

On the other hand, if the Ni amount is excessive, the material cost arises, and segregation is actualized. Also, since the austenite single phase region expands to the high temperature side, the temperature of homogenization heat treatment before hot working needs to be raised. As a result, damage to the heating furnace increases. Furthermore, if the Ni amount is excessive, the SA property and the thermal conductivity are reduced.

For this reason, the Ni amount needs to be less than 0.80 mass %. The Ni amount is preferably 0.75 mass % or less, more preferably 0.70 mass % or less.

(7) 7.50≤Cr≤8.40 Mass %:

If the Cr amount is too small, the corrosion resistance lacks. Also, the impact value decreases. Therefore, the Cr amount needs to be 7.50 mass % or more. The Cr amount is preferably 7.60 mass % or more, more preferably 7.70 mass % or more.

On the other hand, if the Cr amount is excessive, ferrite is likely to be present at the time of homogenization heat treatment before hot working. Also, an increase in the Cr content leads to deterioration of the softening resistance. Therefore, in the case of performing tempering in a high temperature range (temperature range exceeding 510° C.) for the purpose of reducing the residual stress, it is difficult to obtain a hardness of 32 HRC or more. Moreover, if the Cr amount is excessive, the thermal conductivity also decreases.

For this reason, the Cr amount needs to be 8.40 mass % or less. The Cr amount is preferably 8.30 mass % or less, more preferably 8.20 mass % or less.

(8) 0.70<Mo≤1.20 Mass %:

Mo has an action of causing secondary hardening. Therefore, if the Mo amount is too small, in the case of performing tempering in a high temperature range (temperature range exceeding 510° C.) for the purpose of reducing the residual stress, it is difficult to obtain a hardness of 32 HRC or more. In addition, the corrosion resistance lacks.

For this reason, the Mo amount needs to be more than 0.70 mass %. The Mo amount is preferably 0.75 mass % or more, more preferably 0.80 mass % or more.

On the other hand, if the Mo amount is excessive, the material cost rises. In addition, ferrite is likely to be present at the time of homogenization heat treatment before hot working.

For this reason, the Mo amount needs to be 1.20 mass % or less. The Mo amount is preferably 1.15 mass % or less, more preferably 1.10 mass % or less.

(9) 0.01≤V≤0.30 Mass %:

If the V amount is too small, the content of VC or VCN suppressing migration of an austenite crystal grain boundary becomes too small at the time of quenching. Consequently, the crystal grains are likely to excessively grow. If the crystal grains excessively grow during quenching, the impact value decreases.

In addition, V has an action of causing secondary hardening. Therefore, if the V amount is too small, in the case of performing tempering in a high temperature range (temperature range exceeding 510° C.) for the purpose of reducing the residual stress, it is difficult to obtain a hardness of 32 HRC or more.

For this reason, the V amount needs to be 0.01 mass % or more. The V amount is preferably 0.02 mass % or more, more preferably 0.03 mass % or more.

On the other hand, if the V amount is excessive, the material cost rises. In addition, VC or VCN is likely to crystallize in a coarse state during casting of an ingot. Coarse VC or VCN gives rise to a decrease in the impact value. Moreover, if the V amount is excessive, ferrite is likely to be present at the time of homogenization heat treatment before hot working.

For this reason, the V amount needs to be 0.30 mass % or less. The V amount is preferably 0.29 mass % or less, more preferably 0.28 mass % or less.

(10) 0.010≤Al≤0.120 Mass %:

If the Al amount is too small, the content of AlN suppressing migration of an austenite crystal grain boundary becomes too small at the time of quenching. Consequently, the crystal grains are likely to excessively grow. If the crystal grains excessively grow during quenching, the impact value decreases. Furthermore, the steel (ultralow C-8Cr) for a mold according to the present invention has a peculiarity that in the case of ultralow Al, even if the crystal grains are fine, the impact value significantly decreases.

For this reason, the Al amount needs to be 0.010 mass % or more. The Al amount is preferably 0.012 mass % or more, more preferably 0.014 mass % or more.

On the other hand, in order to contain a large amount of Al, the Al amount of an impurity level in a raw material is insufficient, and active addition of Al is required, leading to a rise in the material cost. In addition, if the Al amount is excessive, the content of alumina becomes too large. As a result, not only the impact value decreases but also the mirror polishability deteriorates, because a pinhole is generated due to drop-off of alumina. Moreover, if the Al amount is excessive, the thermal conductivity also decreases.

For this reason, the Al amount needs to be 0.120 mass % or less. The Al amount is preferably 0.115 mass % or less, more preferably 0.110 mass % or less.

In particular, when the O amount is 0.003 mass % or less, an adverse effect of alumina is not actualized. Therefore, in the range of 0.050<Al≤0.110 mass % where the lower limit of the Al amount is increased, the balance among crystal grain size, impact value and mirror polishability is greatly improved.

(11) 0.015≤N≤0.095 Mass %:

If the N amount is too small, the content of AlN suppressing migration of an austenite crystal grain boundary becomes too small at the time of quenching. Consequently, the crystal grains are likely to excessively grow. Also, if the N amount is too small, in the case of performing tempering in a high temperature range (temperature range exceeding 510° C.) for the purpose of reducing the residual stress, it is difficult to obtain a hardness of 32 HRC or more. Moreover, if the N amount is too small, corrosion resistance lacks.

For this reason, the N amount needs to be 0.015 mass % or more. The N amount is preferably 0.017 mass % or more, more preferably 0.020 mass % or more.

On the other hand, in order to contain a large amount of N, the N amount of an impurity level in a raw material is insufficient, and active addition of N is required, leading to a rise in the material cost. In addition, if the N amount is excessive, the content of coarse AlN becomes too large, and the impact value decreases. Furthermore, the thermal conductivity also decreases.

For this reason, the N amount needs to be 0.095 mass % or less. The N amount is preferably 0.090 mass % or less, more preferably 0.080 mass % or less.

(12) Unavoidable Impurities:

As unavoidable impurities, the steel for a mold according to the present invention may contain:

O≤0.005 mass %,
W≤0.30 mass %,
Co≤0.30 mass %,
B≤0.0002 mass %,
Nb≤0.004 mass %,
Ta≤0.004 mass %, Ti≤0.004 mass %,
Zr≤0.004 mass %,
Ca≤0.0005 mass %,
S≤0.003 mass %,
Se≤0.03 mass %,
Te≤0.005 mass %,
Bi≤0.01 mass %,
Pb≤0.03 mass %, and/or
Mg≤0.02 mass %.

[1.1.2. Secondary Constituent Elements (Optional Components)]

In addition to the above-described main constituent elements, the steel for a mold according to the present invention may further contain one element or two or more elements described below. The type of element added, the component range thereof, and the reason for limiting the range are as follows.

(13) 0.30<W≤4.00 Mass %:

The steel for a mold according to the present invention is an ultralow C steel and since the Mo amount and the V amour are also small, the steel may lack the strength depending on use. For imparting high strength to the steel for a mold according to the present invention, it is effective to add W. In order to obtain such an effect, the W amount is preferably more than 0.30 mass %. The W amount is more preferably 0.50 mass % or more, still more preferably 1.00 mass % or more.

On the other hand, if the W amount is excessive, not only significant segregation occurs but also the material cost rises. Accordingly, the W amount is preferably 4.00 mass % or less. The W amount is more preferably 3.90 mass % or less, still more preferably 3.80 mass % or less.

(14) 0.30<Co≤3.00 Mass %:

For imparting high strength to the steel for a mold according to the present invention, it is also effective to add Co in place of W or in addition to W. In order to obtain such an effect, the Co amount is preferably more than 0.30 mass %. The Co amount is more preferably 0.50 mass % or more, still more preferably 1.00 mass % or more.

On the other hand, if the Co amount is excessive, not only significant segregation occurs but also the material cost rises. Accordingly, the Co amount is preferably 3.00 mass % or less. The Co amount is more preferably 2.80 mass % or less, still more preferably 2.50 mass % or less.

(15) 0.0002<B≤0.0080 Mass %:

In the case where the P amount is large, P segregated to the grain boundary reduces the grain boundary strength, and consequently, the impact value decreases in some cases. For improving the grain boundary strength, addition of B is effective. Also, in the case where the total amount of alloy elements is small, ferrite or perlite sometimes precipitates during quenching. For suppressing the precipitation, addition of B is effective as well. In order to obtain such an effect, the B amount is preferably more than 0.0002 mass %. The B amount is more preferably 0.0003 mass % or more, still more preferably 0.0004 mass % or more.

On the other hand, if the B amount is excessive, the productivity is reduced due to prolongation of the refining time or the impact value decreases due to an increase in the content of coarse B compounds. Accordingly, the B amount is preferably 0.0080 mass % or less. The B amount is more preferably 0.0075 mass % or less, still more preferably 0.0070 mass % or less.

Incidentally, in the case of adding B for the purpose of improving the grain boundary strength, it is meaningless if B forms BN. Then, at the time of adding B to a steel having a large N amount, N needs to be combined with an element except for B. Specifically, N is caused to combine with an element capable of forming a nitride, such as Ti, Zr or Nb. These elements are effective even at an impurity level, but if their contents are insufficient, it is preferable to add them in the later-described amounts.

On the other hand, in the case of dispersing BN for improving the machinability, it is not necessary to take a step of actively combining N with a nitride-forming element.

(16) 0.004<Nb≤0.100 Mass %:

(17) 0.004<Ta≤0.100 Mass %:

(18) 0.004<Ti≤0.100 Mass %:

(19) 0.004<Zr≤0.100 Mass %:

Since the steel for a mold according to the present invention is ultralow C and the V amount is not large, VC or VCN suppressing migration of an austenite crystal grain boundary sometimes lacks at the time of quenching. In this case, depending on the quenching conditions, the austenite crystal grains are likely to excessively grow. For suppressing the grain growth, it is effective to add a carbide-, nitride- or carbonitride-forming element (i.e., Nb, Ta, Ti, and/or Zr) and disperse a carbide, etc. in the matrix. In order to obtain such an effect, each of the contents of Nb, Ta, Ti, and Zr is preferably more than 0.004 mass %. Each of the contents of these elements is more preferably 0.006 mass % or more, still more preferably 0.008 mass % or more.

On the other hand, if the contents of these elements are excessive, a carbide, a nitride, or a carbonitride becomes coarse, and the impact value decreases. Also, addition of these elements in amounts more than necessary leads to a rise in the material cost. Accordingly, each of the contents of Nb, Ta, Ti, and Zr is preferably 0.100 mass % or less. Each of the contents of these elements is more preferably 0.090 mass % or less, still more preferably 0.080 mass % or less.

Incidentally, the steel for a mold according to the present invention may be a steel containing any one of Nb, Ta, Ti, and Zr or may be a steel containing two or more thereof.

(20) 0.003<S≤0.250 Mass %:

(21) 0.0005<Ca≤0.2000 Mass %:

(22) 0.03<Se≤0.50 Mass %:

(23) 0.005<Te≤0.100 Mass %:

(24) 0.01<Bi≤0.50 Mass %:

(25) 0.03<Pb≤0.50 Mass %:

The steel for a mold according to the present invention has a relatively small Si amount and a relatively large Cr amount, and therefore, the machinability is sometimes insufficient depending on the cutting conditions. For improving the machinability, it is effective to add an element called free-cutting component (i.e., S, Ca, Se, Te, Bi, and/or Pb). In order to obtain such an effect, each of the contents of S, Ca, Se, Te, Bi, and Pb is preferably an amount more than the above-described lower limit value.

The content of S is preferably 0.004 mass % or more, more preferably 0.005 mass % or more.

The content of Ca is preferably 0.0006 mass % or more, more preferably 0.0007 mass % or more.

The content of Se is preferably 0.04 mass % or more, more preferably 0.05 mass % or more.

The content of Te is preferably 0.006 mass % or more, more preferably 0.007 mass % or more.

The content of Bi is preferably 0.02 mass % or more, more preferably 0.03 mass % or more.

The content of Pb is preferably 0.04 mass % or more, more preferably 0.05 mass % or more.

On the other hand, if the contents of these elements are excessive, not only cracking readily occurs at the time of hot working but also the impact value decreases. For this reason, each of the contents of S, Ca, Se, Te, Bi, and Pb is preferably not more than the upper limit value described above.

The content of S is preferably 0.225 mass % or less, more preferably 0.200 mass % or less.

The content of Ca is preferably 0.1900 mass % or less, more preferably 0.1800 mass % or less.

The content of Se is preferably 0.48 mass % or less, more preferably 0.46 mass % or less.

The content of Te is preferably 0.090 mass % or less, more preferably 0.080 mass % or less.

The content of Bi is preferably 0.450 mass % or less, more preferably 0.400 mass % or less.

The content of Pb is preferably 0.45 mass % or less, more preferably 0.40 mass % or less.

Incidentally, the steel for a mold according to the present invention may be a steel containing any one of S, Ca, Se, Te, Bi, and Pb or may be a steel containing two or more thereof.

[1.2. Properties]

[1.2.1. Hardness]

The steel for a mold according to the present invention is usually used in the state of being thermally refined to a predetermined hardness. In the steel for a mold according to the present invention, when the components and heat treatment conditions are optimized, the hardness after thermal refining is 32 HRC or more and 44 HRC or less.

Here, the "hardness" as used in the present invention refers to a Rockwell hardness measured in a temperature range of 15° C. or more and 35° C. or less and indicates an average value of values measured at randomly selected 5 places in accordance with JIS Z2245:2016.

[1.2.2. Average Absorbed Energy]

The steel for a mold according to the present invention is usually used in the state of being thermally refined to a predetermined hardness. In the steel for a mold according to the present invention, when the components and heat treatment conditions are optimized, the average absorbed energy after thermal refining is 20 J or more.

Here, the "absorbed energy" as used in the present invention refers to a value obtained with a standard specimen of JIS Z2242:2018. More specifically, the "absorbed energy" indicates a value obtained by performing an impact test in a temperature range of 15° C. or more and 35° C. or less by use of a specimen having a notch bottom R=1.0 mm, a notch depth=2 mm (a height beneath notch=8 mm), and a specimen cross-sectional area in the lower part of notch=80 $mm^2$.

The "average absorbed energy" indicates an average value of absorbed energies of 10 specimens.

[2. Manufacturing Method of Steel for Mold]

The steel for a mold according to the present invention can be manufactured by (a) melting, refining and casting raw materials blended to have a predetermined component ranges, (b) subjecting the obtained ingot to a homogenization treatment, (c) hot-working the ingot after homogenization treatment, (d) subjecting the material after hot working to an intermediate heat treatment (normalizing and tempering), (e) subjecting the material after intermediate treatment to spheroidizing annealing (SA), (f) quenching the material after spheroidizing annealing, (g) straightening the material after quenching, and (h) tempering the material after straightening.

The obtained steel for a mold is subjected to cutting machining and then used for various purposes.

Incidentally, depending on the kinds or sizes of steel, the intermediate heat treatment may be omitted but is usually performed. Depending on the kinds of steel, SA may be unnecessary, tempering may be performed a plurality of times, or a tempering step may be provided before and after straightening.

The conditions of each step are not particularly limited, and it is preferable to select optimal conditions so that the intended hardness and average absorbed energy can be obtained in the state of being thermally refined.

[3. Action]

[3.1. Properties Required for Steel for Mold and Mold]

Important properties required for a steel for a mold, which is to be used for various purposes in the state of being thermally refined to a predetermined hardness (so-called "pre-hardened steel material"), and a mold and mold parts manufactured using the steel include the following 6 properties:

(1) SA property (easiness of spheroidizing annealing), (2) tempering hardness (appropriate tempering hardness capable of achieving both high wear resistance and high impact value), (3) residual stress (residual stress low enough to avoid warpage or twisting of the mold), (4) machinability (easiness of cutting machining), (5) impact value (impact value high enough to avoid gross cracking in the mold), and (6) corrosion resistance (corrosion resistance high enough to prevent rusting even when used in a humid environment).

The reasons why these 6 properties are necessary are described below.

[3.1.1. SA Property]

Spheroidizing annealing (SA) is a heat treatment for forming a homogeneous and soft microstructure. Better SA property is preferable. The "better SA property" means that a more homogeneous and softer microstructure is formed by a simple SA process. The reasons why better SA property is preferable are described below.

The SA property becomes a problem in the manufacture of a pre-hardened steel material for a mold. In the pre-hardened steel material, the properties thereof are finally adjusted by quenching and tempering. However, if the steel in the state of SA before quenching has inhomogeneous microstructure and is insufficiently softened, crystal grains may be coarsened at the time of quenching. When crystal grains are coarsened, the properties of the pre-hardened steel material are not optimized.

Accordingly, it is mandatory to obtain a homogeneous and soft microstructure by SA, and as the SA process therefor is simpler, the cost can be lower. In this way, from two viewpoints of the properties of quenched-tempered material and the production cost, the steel for a mold is required to have good SA property.

[3.1.2. Tempering Hardness]

A certain degree of tempering hardness is necessary for ensuring the strength of the mold. If the tempering hardness is too low, shape change due to wear occurs during use of the mold. On the other hand, if the tempering hardness is too high, not only machining into a mold shape is difficult but also the impact value decreases. Consequently, the mold is likely to be subject to gross cracking during its use. For balancing these, the steel for a mold is required to have a tempering hardness of 32 to 44 HRC.

[3.1.3. Residual Stress]

The residual stress becomes a problem at the time of machining the mold. The residual stress is generated during rapid cooling at the time of quenching or during straightening after quenching. If the residual stress of the pre-hardened steel material is high, the mold after machining may deviate from a predetermined dimensional tolerance.

This is because, the balance of the residual stress is changed due to volume removal by machining and, as a result, the mold is warped or twisted. For this reason, the residual stress is preferably lower.

The method for reducing the residual stress includes three methods of (a) reducing the quenching stress, (b) not performing straightening after quenching, and (c) increasing the tempering temperature after straightening.

It is difficult to reduce the residual stress by the first method (method of reducing the quenching stress). This is because, when the quenching rate is decreased to reduce the quenching stress, an incompletely quenched microstructure is formed, and properties necessary for a mold cannot be obtained. As long as rapid cooling at the time of quenching is mandatory, it is difficult to reduce the quenching stress.

On the other hand, in the case of a steel material having high quenchability, rapid cooling at the time of quenching is not mandatory. However, the pre-hardened steel material generally has a large cross-section and therefore, even when rapid quenching is not performed, a large temperature difference is likely to occur between the center and the surface. This large temperature difference generates a high quenching stress.

It is also difficult to reduce the residual stress by the second method (method of not performing straightening). Since rapid cooling is usually indispensable for quenching, a high stress is generated, and the steel material is often deformed (curved, warped). In order to correct and straighten the deformation, straightening by plastically deforming the steel material is necessary. In addition, deformation during hot working sometimes remains at a stage before quenching. In such a case, straightening after quenching is necessary as well.

Accordingly, it is a common practice to reduce the residual stress by using the third method (method of increasing the tempering temperature after straightening). As the heating temperature is higher, the residual stress is more reduced. Therefore, when tempering is performed at a higher temperature within the tempering temperature range where the hardness standard is satisfied, the residual stress can be reduced.

[3.1.4. Machinability]

The machinability becomes a problem when machining the pre-hardened steel material into a mold shape. A channel for flowing a cooling or heating fluid is needed for the mold, and a hole serving as the channel is bored with a drill. Unless the machining speed is decreased, a hole cannot be bored in a steel material having poor machinability, and the drill experiences significant wear. That is, the efficiency is low, and the cost of the drill also rises.

The machinability is greatly affected by the hardness. However, even with the same hardness, when the components of the steel material are different, the machinability often differs as well. The steel for a mold is required to have not only properties necessary for a mold but also high machinability.

[3.1.5. Impact Value]

The impact value is preferably higher. If the impact value is low, the mold is likely to be subject to gross cracking during its use. Since it is difficult to repair gross cracks, the mold having experienced gross cracking needs to be replaced by a brand-new mold. In order to reduce the mold cost, gross cracking of the mold needs to be avoided. To meet this need, the steel for a mold is required to have a high impact value.

[3.1.6. Corrosion Resistance]

The corrosion resistance is preferably higher. The steel for a mold according to the present invention is used in injection molding or blow molding of resins (plastics or vinyls) or in molding or processing, etc. of rubber or various fiber-reinforced plastics. In the mold for such uses, corrosion resistance in a humid environment is important.

The mold used in injection molding, etc. is often used in a high-temperature and high-humidity environment. In such a humid environment, the mold is prone to rust. When the mold has rusted, the rusted portion is transferred to a product to impair the surface quality of the product. In such a case, the rust of the mold must be removed by polishing, but this involves a lot of man-hours and costs. Accordingly, in order to reduce the mold cost, rusting needs to be avoided. To meet this need, the steel for a mold is required to have high corrosion resistance.

Incidentally, for the same reason as above, it is also important to prevent rust during storage of a mold that is not used.

[3.2. Properties of Steel for Mold According to the Present Invention]

Prior to filing of the present invention, there is not in the past a case of proposing a steel material satisfying all of the above-described 6 properties. Also, there is not in the past a case of proposing a steel material excellent in mirror polishability, emboss processability and/or thermal conductive property, in addition to the above-described 6 properties.

On the other hand, in the steel for a mold according to the present invention, components (particularly, Ni, Mo and Al) are optimized and therefore, all of 6 properties of SA property, tempering hardness, residual stress, machinability, impact value and corrosion resistance are satisfied. Specifically, in the steel for a mold according to the present invention, (a) the SA property is higher than that of P21 steel or a high-Ni martensitic stainless steel, (b) the hardness after tempering is an appropriate value of 32 to 44 HRC, (c) the residual stress after tempering is low, (d) the machinability after tempering is higher than that of a martensitic stainless steel, (e) the impact value after tempering is higher than that of P21 steel or a martensitic stainless steel, and (f) the corrosion resistance after tempering, in a humid environment, is higher than that of P21 steel and is as high as that of a martensitic stainless steel.

Accordingly, the steel for a mold according to the present invention is advantageous in that (A) the production cost is lower than that for the conventional steel, (B) deformation during mold processing is very small, making mold processing easy, (C) the mold surface can be polished clean, (D) a crack or rust is less likely to occur during use, and (E) the steel is resistant to rust even at the time of storage during non-use period.

Furthermore, the steel for a mold according to the present invention has excellent mirror surface workability and emboss processability and is higher in the thermal conductivity than a martensitic stainless steel in addition to the above-described 6 properties.

EXAMPLES

Experiment 1: Study of Upper Limit of Ni Amount

[1. Preparation of Sample]

In the manufacture of a pre-hardened steel material for a mold, good SA property is important. In general, when the Ni amount increases, the SA property deteriorates. Then, in order to specify the upper limit of the Ni amount, the effect of the Ni amount on the hardness of SA material was examined. For the steel material, seven kinds of steels differing in the Ni amount, which are a steel (amount of oxygen: 0.002 mass %) having, as a basic component, 0.100C-0.31Si-0.30Mn-0.018P-0.23Cu-7.95Cr-0.95Mo-0.18V-0.051Al-0.047N, were used.

[2. Test Method]

A square bar of 12 mm×12 mm×20 mm was cut out from the steel material. The square bar was held at 870° C. for 1 hour, then slowly cooled to 600° C. at a rate of 30° C./Hr, and furthermore rapidly cooled to 150° C. at 150° C./Hr. After the heat treatment, the Vickers hardness was measured at room temperature.

[3. Results]

FIG. 1 illustrates the effect of Ni amount on the hardness after SA. When the Ni amount is less than 0.80 mass %, the hardness is maintained at a low hardness of 150 HV or less, revealing that there is no problem with the SA property. The reason why the hardness sharply rises at a Ni amount of 0.80 mass % or more is that austenite remaining when reached 600° C. transforms to martensite during the subsequent rapid cooling. Such a state is referred to as "SA defect". When SA defect is generated, additional heat treatment for achieving low hardness is required. Consequently, not only the material cost increases but also coarse grains are formed during quenching, resulting in deterioration of the steel material properties. From FIG. 1, it is understood that the Ni amount needs to be less than 0.80 mass %.

Experiment 2: Study of Lower Limit of Mo Amount

[1. Preparation of Sample]

In the pre-hardened steel material for a mold, it is important to obtain a tempering hardness of 32 HRC or more. If the Mo amount is small, this makes it difficult to obtain a hardness of 32 HRC or more by tempering in a high temperature range (a temperature range exceeding 510° C.), which is performed for the purpose of reducing the residual stress. Then, in order to specify the lower limit of the Mo amount, the effect of the Mo amount on the hardness after tempering was examined. For the steel material, six kinds of steels differing in the Mo amount, which are a steel (amount of oxygen: 0.002 mass %) having, as a basic component, 0.099C-0.30Si-0.31Mn-0.017P-0.22Cu-0.43Ni-7.96Cr-0.18V-0.052Al-0.048N, were used.

[2. Test Method]

A square bar of 12 mm×12 mm×20 mm was cut out from the steel material. The square bar was quenched by rapid cooling from 970° C. and subsequently tempered at 555° C. for 7 hours. After the tempering, the Rockwell hardness (C scale) was measured at room temperature.

[3. Results]

Figure 2:
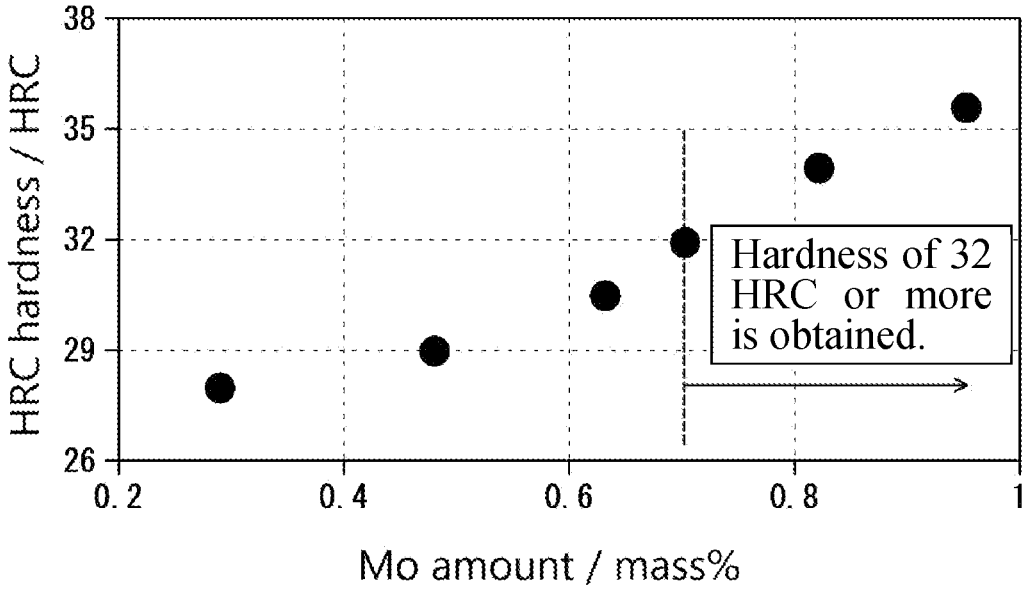
FIG. 2 is a diagram illustrating the effect of Mo amount on the HRC hardness after tempering at 555° C. for 7 hours.

FIG. 2 illustrates the effect of Mo amount on the HRC hardness after tempering at 555° C. for 7 hours. When the Mo amount is less than 0.70 mass %, the hardness is less than 32 HRC, revealing that a predetermined hardness is not obtained. From FIG. 2, it is understood that the Mo amount needs to be more than 0.70 mass %.

Experiment 3: Study of Lower Limit of Al Amount

[1. Preparation of Sample]

In the manufacture of a pre-hardened steel material for a mold, it is important to stably obtain toughness needed for a mold. In the steel (ultralow C-8Cr) for a mold according to the present invention, the impact value is significantly affected by Al. Then, in order to specify the lower limit of the Al amount, the effect of the Al amount on the absorbed energy in an impact test was examined. For the steel material, four kinds of steels differing in the Al amount, which are a steel (amount of oxygen: 0.002 mass %) having, as a basic component, 0.101C-0.31Si-0.31Mn-0.019P-0.22Cu-0.44Ni-7.96Cr-0.96Mo-0.19V-0.047N, were used.

[2. Test Method]

A square bar of 12 mm×12 mm×55 mm was cut out from the steel material. The square bar was quenched by rapid cooling from 970° C., subsequently tempered at 555° C. for 7 hours, and thereby thermally refined to 36 HRC). An impact test specimen of 10 mm×10 mm×55 mm was prepared from the square bar and subjected to an impact test at room temperature. In conformity with JIS Z 2242:2018, the notch area of the test specimen had a notch bottom R=1.0 mm, a height beneath notch=8 mm, and a specimen cross-sectional area in the lower part of notch=80 $mm^2$. For each kind of steel, 10 specimens were prepared, and the effect of Al amount was evaluated by the average value of absorbed energies.

[3. Results]

Figure 3:
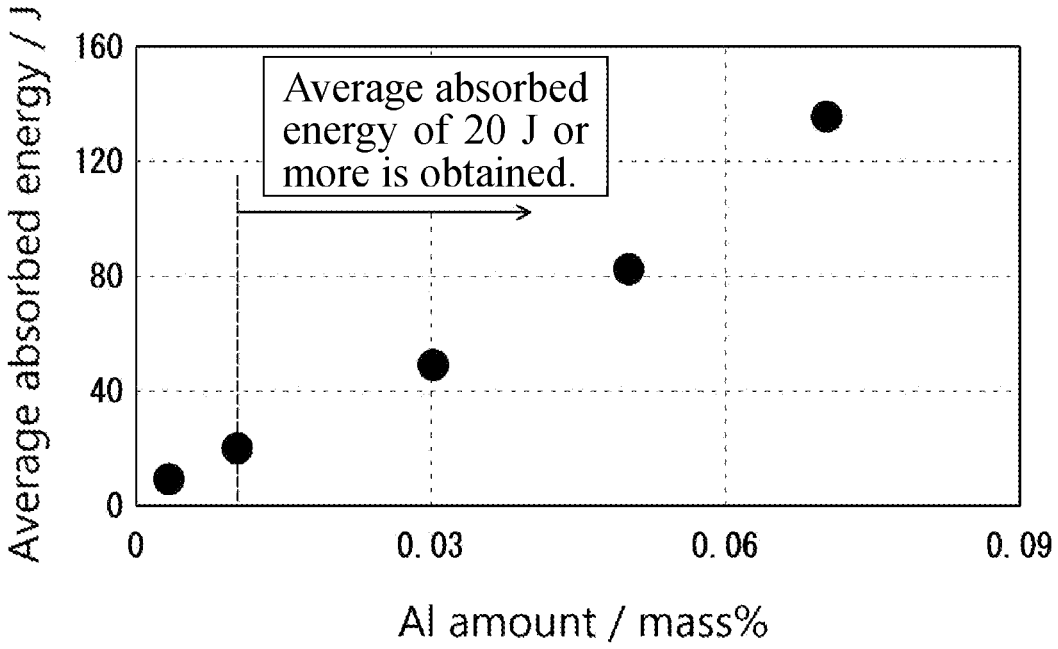
FIG. 3 is a diagram illustrating the effect of Al amount on the average absorbed energy of 36 HRC material.

FIG. 3 illustrates the effect of Al amount on the average absorbed energy of a 36 HRC material. When the Al amount is more than 0.010 mass %, the average absorbed energy is 20 J or more, revealing that the risk of cracking of the mold is considerably reduced. From FIG. 3, it is understood that the Al amount needs to be more than 0.010 mass %.

Furthermore, when the Al amount is more than 0.050 mass %, the average absorbed energy exceeds 80 J, revealing that the risk of cracking of the mold becomes very low.

Examples 1 to 18 and Comparative Examples 1 to 8

[1. Preparation of Sample]

Chemical components of 26 kinds of steel used for the evaluation are shown in Table 1. Although not shown in the Table, other elements each present in an amount less than the specified amount may sometimes be contained as impurities.

Here, the material of Comparative Example 1 is a steel commercially available as P21 steel. The material of Comparative Example 2 is a steel commercially available as P20 steel. The material of Comparative Example 3 is a steel prepared by increasing the P amount of Comparative Example 2. The material of Comparative Example 4 is SKD61.

The material of Comparative Example 5 is 8Cr steel like the steel for a mold according to the present invention but compared with the present invention, the C amount and the Mo amount are small and the Ni amount is large. The material of Comparative Example 6 is also 8Cr steel like the steel for a mold according to the present invention but compared with the present invention, the C amount and the V amount are large and the Mo amount is small. The material of Comparative Example 7 is a representative steel of medium-C martensitic stainless steels. The material of Comparative Example 8 is a martensitic stainless steel as well but compared with Comparative Example 7, the C amount is small and the Ni amount, Mo amount, V amount and N amount are large. In Comparative Examples 1 to 8, among main 11 elements (C, Si, Mn, P, Cu, Ni, Cr, Mo, V, Al, N), at least 4 elements are out of the component range of the steel for a mold according to the present invention.

TABLE 1

| | | C | Si | Mn | P | Cu | Ni | Cr | Mo | V | Al | N | O | Others |
|---|---|---|---|---|---|---|---|---|---|---|---|---|---|---|
| Example | 1 | 0.070 | 0.59 | 0.59 | 0.027 | 0.01 | 0.005 | 8.38 | 1.20 | 0.01 | 0.118 | 0.090 | 0.001 | |
| | 2 | 0.075 | 0.05 | 0.55 | 0.005 | 0.03 | 0.008 | 8.30 | 1.15 | 0.02 | 0.110 | 0.027 | 0.002 | |
| | 3 | 0.120 | 0.10 | 0.13 | 0.065 | 0.96 | 0.70 | 7.70 | 0.80 | 0.28 | 0.014 | 0.042 | 0.001 | |
| | 4 | 0.081 | 0.23 | 0.43 | 0.110 | 0.36 | 0.13 | 8.08 | 0.91 | 0.20 | 0.046 | 0.080 | 0.001 | |
| | 5 | 0.101 | 0.39 | 0.27 | 0.036 | 1.14 | 0.56 | 7.89 | 1.02 | 0.10 | 0.073 | 0.059 | 0.001 | |
| | 6 | 0.100 | 0.28 | 0.31 | 0.018 | 0.02 | 0.41 | 7.94 | 0.94 | 0.18 | 0.036 | 0.048 | 0.001 | |
| | 7 | 0.100 | 0.44 | 0.33 | 0.027 | 0.22 | 0.49 | 7.98 | 0.96 | 0.17 | 0.055 | 0.049 | 0.001 | |
| | 8 | 0.090 | 0.33 | 0.37 | 0.007 | 0.51 | 0.27 | 8.02 | 0.98 | 0.15 | 0.091 | 0.069 | 0.002 | |
| | 9 | 0.112 | 0.19 | 0.21 | 0.049 | 0.79 | 0.63 | 7.82 | 0.87 | 0.23 | 0.025 | 0.035 | 0.001 | |
| | 10 | 0.080 | 0.50 | 0.50 | 0.089 | 0.65 | 0.01 | 8.20 | 1.10 | 0.03 | 0.109 | 0.020 | 0.001 | |
| | 11 | 0.125 | 0.55 | 0.09 | 0.003 | 1.39 | 0.75 | 7.60 | 0.75 | 0.29 | 0.012 | 0.017 | 0.001 | |
| | 12 | 0.130 | 0.02 | 0.02 | 0.130 | 1.29 | 0.79 | 7.52 | 0.71 | 0.30 | 0.010 | 0.015 | 0.001 | |
| | 13 | 0.101 | 0.29 | 0.31 | 0.018 | 0.22 | 0.40 | 7.95 | 0.95 | 0.19 | 0.052 | 0.047 | 0.001 | 1.52 Co |
| | 14 | 0.099 | 0.30 | 0.30 | 0.018 | 0.21 | 0.41 | 7.96 | 0.95 | 0.18 | 0.054 | 0.048 | 0.001 | 3.61 W |
| | 15 | 0.100 | 0.29 | 0.31 | 0.021 | 0.25 | 0.41 | 7.97 | 0.96 | 0.18 | 0.055 | 0.047 | 0.001 | 0.03 Ti |
| | 16 | 0.100 | 0.28 | 0.31 | 0.019 | 0.22 | 0.40 | 7.96 | 0.95 | 0.19 | 0.054 | 0.048 | 0.001 | 0.0009 B, 0.03 Ti |
| | 17 | 0.099 | 0.29 | 0.29 | 0.020 | 0.23 | 0.41 | 7.95 | 0.94 | 0.18 | 0.052 | 0.048 | 0.001 | 0.04 Nb |
| | 18 | 0.101 | 0.29 | 0.31 | 0.020 | 0.22 | 0.39 | 7.95 | 0.95 | 0.18 | 0.053 | 0.047 | 0.001 | 0.024 S |
| Comparative Example | 01 | 0.120 | 0.31 | 1.50 | 0.013 | 1.02 | 3.31 | 0.23 | 0.30 | 0.01 | 1.01 | 0.006 | 0.001 | |
| | 02 | 0.161 | 0.31 | 1.59 | 0.014 | 0.08 | 0.03 | 2.21 | 0.40 | 0.11 | 0.005 | 0.011 | 0.002 | 0.034 S |
| | 03 | 0.162 | 0.32 | 1.58 | 0.193 | 0.07 | 0.03 | 2.23 | 0.39 | 0.10 | 0.006 | 0.009 | 0.002 | 0.036 S |
| | 04 | 0.381 | 1.01 | 0.46 | 0.012 | 0.09 | 0.04 | 5.21 | 1.23 | 0.92 | 0.016 | 0.012 | 0.002 | |
| | 05 | 0.060 | 0.28 | 0.31 | 0.019 | 0.03 | 0.99 | 7.91 | 0.42 | 0.08 | 0.003 | 0.009 | 0.001 | |
| | 06 | 0.326 | 0.23 | 0.55 | 0.014 | 0.04 | 0.18 | 7.95 | 0.60 | 0.60 | 0.017 | 0.014 | 0.002 | |
| | 07 | 0.380 | 1.03 | 0.40 | 0.015 | 0.13 | 0.17 | 13.41 | 0.08 | 0.23 | 0.029 | 0.015 | 0.001 | |
| | 08 | 0.241 | 0.27 | 0.57 | 0.012 | 0.11 | 1.37 | 13.29 | 0.34 | 0.36 | 0.010 | 0.104 | 0.001 | |

The steel material properties were verified by not using an industrial large-size ingot (1,000 kg or more) but using a small test-size ingot. In the verification of the steel material properties, an industrial process (manufacture of pre-hardened steel material, thermal refining of mold) is simulated, and the performance when used in practice can thereby be accurately judged.

Each of 26 kinds of steel shown in Table 1 was cast into a 50-kg ingot. Subsequently, an about 2,000 mm-long bar material having a rectangular cross-section with a height of 40 mm and a width of 65 mm was produced by hot working. Note that the bar material obtained by hot working had been subjected to homogenization heat treatment at 860 to 1,060° C. The temperature of the homogenization heat treatment was changed depending on the kinds of steel to form austenite single phase by taking into account the temperature at which ferrite exists.

The bar material obtained by hot working was further subjected to normalizing by soaking at 1,060° C. for 2 hours and tempering by soaking at 580 to 750° C. for 8 hours. The temperature of the normalizing was changed depending on the kinds of steel by taking into account the crystal grain size and the amount of non-solid solution carbide. The temperature of tempering was changed depending on the kinds of steel by taking into account the temperature (transformation point, $A_{c1}$) at which austenite starts to form.

[2. Evaluation]

Various specimens were prepared from the above-described bar material and examined for 6 properties of (1) SA property, (2) tempering hardness, (3) residual stress, (4) machinability, (5) impact value, and (6) corrosion resistance.

[2.1. SA Property]

[2.1.1. Test Method]

A specimen (square bar) of 12 mm×12 mm×20 mm was cut out from the bar material described above. In the test, a vacuum furnace that the specimen can be cooled by nitrogen gas jet was used. Each specimen was heated in a vacuum at an appropriate temperature of 840 to 945° C., held for 1 hour, then slowly cooled to 600° C. at a rate of 30° C./Hr, and after that, rapidly cooled to 150° C. at 150° C./Hr. In heating, an appropriate temperature was selected by taking into account the $A_{c3}$ point of each kind of steel or the amount of non-solid solution carbide at the heating temperature.

The hardness of the above-described specimen was measured at room temperature. Indentations for the measurement of hardness were stamped at appropriate intervals at 5 places around the center of the specimen surface, and the average value of 5 places was used for the evaluation of the SA property. When the hardness is 97 HRB (corresponding to 233 HV) or less, it is determined that the specimen is sufficiently softened and the SA property is good. However, the hardness varies depending on the C amount. On the other hand, a specimen having a hardness of more than 97 HRB cannot any more be evaluated on the HRB scale and was re-measured on the HRC scale.

[2.1.2. Results]

The results are shown in Table 2. In Table 2, a soft material having a hardness of 97 HRB or less is indicated by "S" judging the SA property is Superior. On the other hand, a material having a hardness of more than 97 HRB is indicated by "I" judging the SA property is Inferior.

TABLE 2

| | | Heating Temperature | Cooling 30° C./Hr Hardness | Judgment |
|---|---|---|---|---|
| Example | 1 | 840° C. | 79 HRB | S |
| | 2 | 840° C. | 80 HRB | S |
| | 3 | 870° C. | 84 HRB | S |
| | 4 | 855° C. | 81 HRB | S |
| | 5 | 870° C. | 83 HRB | S |
| | 6 | 870° C. | 83 HRB | S |
| | 7 | 870° C. | 83 HRB | S |
| | 8 | 870° C. | 82 HRB | S |
| | 9 | 870° C. | 83 HRB | S |
| | 10 | 855° C. | 81 HRB | S |
| | 11 | 870° C. | 84 HRB | S |
| | 12 | 870° C. | 85 HRB | S |
| | 13 | 870° C. | 84 HRB | S |
| | 14 | 870° C. | 84 HRB | S |
| | 15 | 870° C. | 83 HRB | S |
| | 16 | 870° C. | 83 HRB | S |

TABLE 2-continued

| | | Heating Temperature | Cooling 30° C./Hr Hardness | Judgment |
|---|---|---|---|---|
| | 17 | 870° C. | 83 HRB | S |
| | 18 | 870° C. | 83 HRB | S |
| Comparative Example | 01 | 840° C. | 32 HRC | I |
| | 02 | 870° C. | 37 HRC | I |
| | 03 | 870° C. | 37 HRC | I |
| | 04 | 900° C. | 88 HRB | S |
| | 05 | 870° C. | 35 HRC | I |
| | 06 | 870° C. | 85 HRB | S |
| | 07 | 945° C. | 93 HRB | S |
| | 08 | 870° C. | 40 HRC | I |

In all of Examples 1 to 18, the materials were softened to a hardness of 97 HRB or less by SA. Although a material having a larger C amount tends to increase in hardness, the materials were softened to a hardness posing absolutely no problem at the time of cutting machining into a mold shape by means of a drill or an end mill. In all of Examples 1 to 18, the materials were softened by a simple SA process, revealing that the SA property is very high.

Of Comparative Examples 1 to 8, the materials of Comparative Examples 4, 6 and 7 were softened to a hardness of 97 HRB or less. In these materials, since the C amount and the Cr amount are large and the Mn amount and the Ni amount are small, spheroidization of the carbide was accelerated, as a result, the SA property was improved.

On the other hand, in Comparative Examples 1 to 3, 5 and 8, the hardness exceeds 97 HRB, and the SA property is poor. Among others, in the material of Comparative Example 5 where the C amount is more decreased and the Ni amount was more increased than those in the steel for a mold according to the present invention, spheroidization of the carbide was suppressed, and the material was not easily softened.

When the conditions in the above-describe test process are applied to the industrial SA process, they correspond to the conditions that (a) a large block produced from a large ingot of 1,000 kg or more is heated in a furnace at a predetermined temperature just above the $A_{c3}$ point, (b) the block is held at a predetermined temperature for 1 hour, and (c) the block is slowly cooled and removed from the furnace when the furnace temperature reaches 600° C.

In such SA process simulating actual production, the materials of Examples 1 to 18 were softened to a hardness of 97 HRB or less. Accordingly, it is determined that in the actual production of a large pre-hardened steel material (block) for a mold, the steel for a mold according to the present invention exhibits good SA property as well.

[2.2. Tempering Hardness]

[2.2.1. Test Method]

A specimen (square bar) of 12 mm×12 mm×20 mm was cut out from the bar material described above. In the test, a vacuum furnace that the specimen can be cooled by nitrogen gas jet was used. It is verified whether a predetermined hardness can be obtained by quenching and then tempering the specimen.

The heating temperature in quenching each specimen was set to be from 870 to 1,030° C. The reason why the heating temperature differs depending on the kinds of steel is because the heating temperature giving the best balance between strength and toughness after tempering differs depending on the kinds of steel. Each specimen was held at a predetermined quenching temperature for 2 hours in a vacuum, then cooled to 600° C. at a rate of 20° C./min, and after that, cooled to 150° C. at 2° C./min. Thereafter, the specimen was removed from the furnace and cooled to 50° C. or less. The quenching conditions up to 150° C. simulate the quenching of a large (industrial size) block of approximately 300 mm in height and 500 mm in width.

After the quenching described above, tempering was performed. The specimen was heated at 555° C. in a vacuum, held at 555° C. for 7 hours, and then cooled to 150° C. at 100° C./Hr. This tempering simulates the conditions applied for the purpose of "reduction of the residual stress" in the actual production of a pre-hardened steel for a mold.

After the tempering, the hardness was measured at room temperature. Indentations for the measurement of hardness were stamped at appropriate intervals at 5 places around the center of the specimen surface, and the average value of 5 places was used for the evaluation. When the hardness is 32 HRC or more, it is determined that the specimen has hardness needed for a mold.

[2.2.2. Results]

The results are shown in Table 3. In Table 3, a material having a hardness of 32 HRC or mores is indicated by "S" judging the tempering hardness is Superior. On the other hand, a material having a hardness of less than 32 HRC is indicated by "I" judging the tempering hardness is Inferior.

TABLE 3

| | | Quenching Temperature | 555° C. Tempering HRC Hardness | Judgment |
|---|---|---|---|---|
| Example | 1 | 970° C. | 34 | S |
| | 2 | 970° C. | 33 | S |
| | 3 | 970° C. | 36 | S |
| | 4 | 970° C. | 35 | S |
| | 5 | 970° C. | 36 | S |
| | 6 | 970° C. | 36 | S |
| | 7 | 970° C. | 36 | S |
| | 8 | 970° C. | 35 | S |
| | 9 | 970° C. | 36 | S |
| | 10 | 970° C. | 35 | S |
| | 11 | 970° C. | 37 | S |
| | 12 | 970° C. | 38 | S |
| | 13 | 970° C. | 37 | S |
| | 14 | 970° C. | 37 | S |
| | 15 | 970° C. | 36 | S |
| | 16 | 970° C. | 36 | S |
| | 17 | 970° C. | 36 | S |
| | 18 | 970° C. | 36 | S |
| Comparative Example | 01 | 900° C. | 36 | S |
| | 02 | 970° C. | 37 | S |
| | 03 | 970° C. | 37 | S |
| | 04 | 1030° C. | 52 | S |
| | 05 | 870° C. | 28 | I |
| | 06 | 1030° C. | 48 | S |
| | 07 | 1030° C. | 40 | S |
| | 08 | 1030° C. | 44 | S |

In all of Examples 1 to 18, the hardness was 33 HRC or more. In all of Examples 1 to 18, the materials were not excessively softened even by high-temperature heating aimed at "reduction of residual stress" and kept hardness needed for a mold.

Of Comparative Examples 1 to 8, the materials of Comparative Examples 1 to 4 and 6 to 8 also kept hardness needed for a mold. However, in Comparative Example 5 which is a material where the C amount and the Mo amount were decreased compared with those of the steel for a mold according to the present invention, since the C amount and softening resistance were insufficient, the hardness was reduced to 28 HRC.

Incidentally, it has been found by another experiment that in order to increase the hardness of Comparative Example 5 to 37 HRC equivalent to that of Examples, the tempering temperature held for 7 hours must be lowered to 505° C. On the other hand, in Comparative Example 6, the hardness exceeded 44 HRC, but when the tempering temperature is raised above 555° C., the material can be thermally refined to a hardness of 32 to 44 HRC.

When the conditions in the above-described test process are applied to the industrial quenching-tempering process, they correspond to the conditions that (a) a large block produced from a large ingot of 1,000 kg or more is quenched and (b) tempering by holding at 555° C. for 7 hours for concurrently achieving reduction of residual stress is performed.

Alternatively, they correspond to the conditions that (a) a large block produced from a large ingot of 1,000 kg or more is quenched, (b) the block is tempered at 450° C. or less so as to prevent delayed cracking (a phenomenon where after quenching, cracking occurs while waiting for tempering), and (c) after that, tempering by holding at 555° C. for 7 hours for concurrently achieving reduction of residual stress is performed.

In such quenching-tempering process simulating actual production, the materials of Examples 1 to 18 kept a tempering hardness of 33 HRC or more. Accordingly, it is determined that in the actual production of a large pre-hardened steel material for a mold, the steel for a mold according to the present invention is not excessively softened as well by high-temperature heating aimed at reduction of residual stress and can keep a hardness of 32 HRC or more.

[2.3. Residual Stress]

[2.3.1. Test Method]

As described above, the materials of Examples 1 to 18 could keep a hardness of 32 HRC or more even after tempering (holding at 555° C. for 7 hours) performed for concurrently achieving reduction of residual stress. Then, whether the residual stress actually decreases to a problem-free level under these heating conditions was evaluated.

Two specimens each sized 25 mm×40 mm×50 mm with the surface being smooth were prepared from the bar material described above. These specimens were quenched in a vacuum under the same conditions as in the experiment of "Tempering Hardness" described above. After tempering, they were cooled by holding them at 300° C. for 2 hours so as to prevent cracking. Furthermore, shot blasting was applied to the surface of the specimen.

The purpose of shot blasting is to introduce residual stress by work hardening. The residual stress that becomes a problem in the actual production of a pre-hardened steel for a mold is generated by quenching or straightening, but residual stress in the specimen was generated by work hardening with shot blasting to simulate and substitute the residual stress by quenching or straightening.

In the evaluations of 6 properties, from a small-size ingot, a smaller bar material was produced and used as a material for evaluation. A still smaller specimen was prepared from the material. Since the specimen is small, the quenching stress does not increase, and since straightening of the material is not performed, it is difficult to introduce high residual stress close to that in actual production. Then, for simulating an actual phenomenon of introduction of residual stress by work hardening, shot blasting similarly causing work hardening was used.

After the shot blasting described above, of two specimens, a first specimen was heated in a vacuum by holding at 505° C. for 7 hours and cooled to 150° C. at 100° C./Hr. Heating for the purpose of reduction of the residual stress is generally conducted in a temperature range exceeding 510° C. and therefore, the heating temperature of 505° C. is a considerably low temperature.

On the other hand, a second specimen was heated in a vacuum at 555° C. for 7 hours and cooled to 150° C. at 100° C./Hr. These heating conditions are the same as in the experiment of "Tempering Hardness" and positioned as tempering for concurrently achieving reduction of residual stress.

After performing tempering at 505° C. or 555° C., the residual stress was measured in accordance with JIS K0131: 1996.

[2.3.2. Results]

The results are shown in Table 4. In Table 4, a material having an absolute value of residual stress of 100 MPa or less is indicated by "S" judging the reduction of residual stress is Superior. On the other hand, a material having an absolute value of residual stress of more than 100 MPa is indicated by "I" judging the reduction of residual stress is Inferior.

TABLE 4

| | | Residual Stress of Heating at 505° C. | | Residual Stress of Heating at 555° C. | |
|---|---|---|---|---|---|
| | | MPa | Judgment | MPa | Judgment |
| Example | 1 | −252 | I | −43 | S |
| | 2 | −259 | I | −45 | S |
| | 3 | −275 | I | −51 | S |
| | 4 | −271 | I | −50 | S |
| | 5 | −282 | I | −52 | S |
| | 6 | −273 | I | −48 | S |
| | 7 | −280 | I | −51 | S |
| | 8 | −270 | I | −47 | S |
| | 9 | −275 | I | −47 | S |
| | 10 | −273 | I | −47 | S |
| | 11 | −303 | I | −49 | S |
| | 12 | −327 | I | −54 | S |
| | 13 | −286 | I | −53 | S |
| | 14 | −291 | I | −53 | S |
| | 15 | −276 | I | −50 | S |
| | 16 | −281 | I | −47 | S |
| | 17 | −273 | I | −48 | S |
| | 18 | −276 | I | −50 | S |
| Comparative Example | 01 | −280 | I | −51 | S |
| | 02 | −299 | I | −54 | S |
| | 03 | −291 | I | −53 | S |
| | 04 | −364 | I | −62 | S |
| | 05 | −263 | I | −47 | S |
| | 06 | −357 | I | −58 | S |
| | 07 | −338 | I | −52 | S |
| | 08 | −340 | I | −54 | S |

As for tempering at 505° C., in all of Examples 1 to 18 and Comparative Examples 1 to 8, the residual stress is approximately from −360 to −250 MPa, and remaining of strong compressive stress was confirmed. On the other hand, as for tempering at 555° C., in all of Examples 1 to 18 and Comparative Examples 1 to 8, the residual stress is approximately from −70 to −40 MPa, and the compressive stress was greatly reduced. With respect to the residual stress, it is understood that the heating temperature has a greater effect than the steel material components.

When the conditions in the above-described test process are applied to the industrial quenching-tempering process, they correspond to the conditions that (a) a large block produced from a large ingot of 1,000 kg or more is quenched and (b) tempering by holding at 555° C. for 7 hours for concurrently achieving reduction of residual stress is performed.

Alternatively, they correspond to the conditions that (a) a large block produced from a large ingot of 1,000 kg or more is quenched, (b) the block is tempered at 450° C. or less so as to prevent delayed cracking (a phenomenon where after quenching, cracking occurs while waiting for tempering), and (c) after that, tempering by holding at 555° C. for 7 hours for concurrently achieving reduction of residual stress is performed.

In such quenching-tempering process simulating actual production, the absolute value of residual stress of the steel for a mold according to the present invention was reduced to 100 MPa or less. Accordingly, it is determined that in the actual production of a large pre-hardened steel material for a mold, the steel for a mold according to the present invention is sufficiently reduced in the residual stress as well by high-temperature heating aimed at reduction of residual stress and can keep a hardness of 32 HRC or more.

Incidentally, the plus/minus sign or absolute value of residual stress differs depending on the conditions (e.g., shape, quenching rate, degree of straightening) and therefore, the numerical values of Table 4 are not always obtained. The important thing is the fact that when heated at 555° C., the residual stress can be greatly reduced as compared with the case of heating at 510° C. or less.

The effect of reducing the residual stress is prominent in the heating to a temperature range exceeding 510° C. and therefore, if high hardness is required, heating to a temperature range of more than 510° C. and less than 555° C. is only needed.

Also, the block may be heated to a temperature range exceeding 555° C. for further reducing the residual stress as long as it is in the range where a hardness of 32 HRC or more is obtained.

Incidentally, in the experiment of [2.3.1.] for verifying the effect of reducing the residual stress, the holding time was 7 hours, but depending on the productivity, acceptable level of residual stress, furnace performance, etc., the holding time may be less than 7 hours or may exceed 7 hours. It may be sufficient if a combination of temperature and time with which necessary hardness and low residual stress are obtained is selected.

[2.4. Machinability]

[2.4.1. Test Method]

Specimens of 25 mm×40 mm×200 mm were cut out from the bar material described above. The specimens were quenched in a vacuum under the same conditions as in the experiment of "Tempering Hardness" described above. Subsequently, each bar material was thermally refined to 37 HRC by tempering in a vacuum. As for the tempering conditions, a combination of temperature and time was properly selected according to the kinds of steel.

The bar material described above was subjected to a machinability test of boring a hole of 5 mm in diameter and 20 mm in depth by means of a drill. For the drill, a type that is made of SKH51 and surface non-treated was used. The machinability was evaluated by VL1000. The "VL1000" as used herein means a machining speed (m/min) at which the drill comes to the end of its life when reached a cutting distance (=depth of hole: 20 mm×number of holes bored) of 1,000 mm (corresponding to 50 holes). VL1000 is an index of machining efficiency, and since as this value is larger, the holes can be bored at a higher speed, the steel can be judged to have excellent machining efficiency and good machinability.

[2.4.2. Results]

The results are shown in Table 5. Incidentally, kinds of steel having VL1000 of 20 m/min or more exhibit good machinability in the machining of a mold. Therefore, in Table 5, a material having VL1000 of 20 mm/min or more is indicated by "S" judging the machinability is Superior. On the other hand, a material having VL1000 of less than 20 mm/min is indicated by "I" judging the machinability is Inferior.

TABLE 5

| | | VL1000 of 37 HRC m/min | Judgment |
|---|---|---|---|
| Example | 1 | 22 | S |
| | 2 | 22 | S |
| | 3 | 23 | S |
| | 4 | 25 | S |
| | 5 | 27 | S |
| | 6 | 22 | S |
| | 7 | 22 | S |
| | 8 | 22 | S |
| | 9 | 23 | S |
| | 10 | 24 | S |
| | 11 | 26 | S |
| | 12 | 28 | S |
| | 13 | 22 | S |
| | 14 | 22 | S |
| | 15 | 22 | S |
| | 16 | 22 | S |
| | 17 | 22 | S |
| | 18 | 41 | S |
| Comparative Example | 01 | 29 | S |
| | 02 | 47 | S |
| | 03 | 49 | S |
| | 04 | 29 | S |
| | 05 | 22 | S |
| | 06 | 23 | S |
| | 07 | 18 | I |
| | 08 | 16 | I |

In all of Examples 1 to 18, VL1000 was 22 in/min or more. Similarly, in all of Comparative Examples 1 to 6, VL1000 was 22 m/min or more. However, in both Comparative Example 7 and Comparative Example 8, VL1000 was 18 in/min or less.

Actually, the materials of Comparative Example 7 and Comparative Example 8 are known as a kind of steel having poor machinability. On the other hand, the material of Comparative Example 1 is said to exhibit good machinability in the machining of a mold and had VL1000 as large as 29 in/min. The material of Comparative Example 5 is ultralow C-8Cr steel like the steel for a mold according to the present invention and exhibited VL1000 equivalent to that of the steel for a mold according to the present invention. As an overall tendency of all kinds of steel evaluated, a steel where the P amount, S amount and/or Cu amount are relatively large exhibited good machinability.

When the conditions in the above-described test process are applied to the industrial production process of a mold, they correspond to the conditions that (a) a large block produced from a large ingot of 1,000 kg or more is quenched and tempered to thermally refine the block to 37 HRC and (b) at the time of manufacturing a mold from the block, drill machining is performed.

In such mold manufacturing process simulating actual production, VL1000 of the steel for a mold according to the present invention was good. Consequently, it is determined that in the actual production of machining a mold from a large pre-hardened steel material, the steel for a mold according to the present invention can ensure sufficient machinability as well.

[2.5. Impact Value]

[2.5.1. Test Method]

A square bar of 11 mm×11 mm×55 mm was cut out from the bar material described above. The square bar was heat-treated under the same conditions as in the experiment of "Machinability" and thereby thermally refined to 37 HRC. An impact test specimen of 10 mm×10 mm×55 mm was prepared from the square bar and subjected to an impact test at room temperature. In conformity with JIS Z 2242: 2018, a U notch was provided at the center of the specimen to have a notch bottom R=1.0 mm, a height beneath notch=8 mm, and a specimen cross-sectional area in the lower part of notch=80 $mm^2$. For each kind of steel, 10 specimens were prepared, and an average value of absorbed energies was calculated.

[2.5.2. Results]

The results are shown in Table 6. Incidentally, there is an empirical rule that when the average absorbed energy is 20 J or more, the risk of cracking of the mold significantly decreases. Therefore, in Table 6, a material having an average absorbed energy of 20 J or more is indicated by "S" judging the toughness is Superior. On the other hand, a material having an average absorbed energy of less than 20 J is indicated by "I" judging the toughness is Inferior.

TABLE 6

| | | Average Absorbed Energy of 37 HRC J | Judgment |
|---|---|---|---|
| Example | 1 | 149 | S |
| | 2 | 163 | S |
| | 3 | 153 | S |
| | 4 | 124 | S |
| | 5 | 166 | S |
| | 6 | 173 | S |
| | 7 | 181 | S |
| | 8 | 152 | S |
| | 9 | 146 | S |
| | 10 | 142 | S |
| | 11 | 131 | S |
| | 12 | 119 | S |
| | 13 | 120 | S |
| | 14 | 121 | S |
| | 15 | 178 | S |
| | 16 | 167 | S |
| | 17 | 155 | S |
| | 18 | 82 | S |
| Comparative Example | 01 | 16 | I |
| | 02 | 19 | I |
| | 03 | 15 | I |
| | 04 | 30 | S |
| | 05 | 10 | I |
| | 06 | 42 | S |
| | 07 | 14 | I |
| | 08 | 12 | I |

In all of Examples 1 to 18, the average absorbed energy was a high value exceeding 80 J. Of Comparative Examples 1 to 8, the average absorbed energy was 20 J or more only in two kinds of steel of Comparative Example 4 and Comparative Example 6. Particularly, the material of Comparative Example 5 is 8Cr steel like those of Comparative Example 6 or Examples 1 to 18, but since the Al amount is as low as 0.003 mass %, the average absorbed energy was very low, i.e., 10 J.

When the conditions in the above-described test process are applied to the production process of an industrial pre-hardened steel material, they correspond to the conditions that a large block produced from a large ingot of 1,000 kg or more is quenched-tempered and thereby thermally refined to 37 HRC.

In such pre-hardened steel material production process simulating actual production, the average absorbed energy of the steel for a mold according to the present invention was very high. Accordingly, it is determined that in a large pre-hardened steel material manufactured in actual production, the steel for a mold according to the present invention can ensure sufficient average absorbed energy as well.

[2.6. Corrosion Resistance]

[2.6.1. Test Method]

A plate of 41 mm×21 mm×51 mm was cut out from the bar material described above and thermally refined to 37 HRC by heat-treating it under the same conditions as in the experiment of "Machinability". A specimen of 40 mm×20 mm×50 mm was prepared from the plate, and the surface thereof was polished to a mirror state. This specimen was exposed for 2 hours to a high-temperature and humid environment at a temperature: 50° C. and a humidity: 98% to compare rusting conditions.

[2.6.2. Results]

The results are shown in Table 7. In Table 7, a material where rusting was not observed is indicated by "S" judging the corrosion resistance is Superior. On the other hand, a material where rusting was observed is indicated by "I" judging the corrosion resistance is Inferior.

TABLE 7

| | | Rusting of 37 HRC At temperature of 50° C. and humidity of 98% for 2 hours | Judgment |
|---|---|---|---|
| Example | 1 | none | S |
| | 2 | none | S |
| | 3 | none | S |
| | 4 | none | S |
| | 5 | none | S |
| | 6 | none | S |
| | 7 | none | S |
| | 8 | none | S |
| | 9 | none | S |
| | 10 | none | S |
| | 11 | none | S |
| | 12 | none | S |
| | 13 | none | S |
| | 14 | none | S |
| | 15 | none | S |
| | 16 | none | S |
| | 17 | none | S |
| | 18 | none | S |
| Comparative Example | 01 | observed | I |
| | 02 | observed | I |
| | 03 | observed | I |
| | 04 | observed | I |
| | 05 | none | S |
| | 06 | observed | I |
| | 07 | none | S |
| | 08 | none | S |

In all of Examples 1 to 18, rust did not occur. On other hand, of Comparative Examples, rust did not occur only in three kinds of steel of Comparative Example 5, Comparative Example 7 and Comparative Example 8. The materials of Comparative Example 7 and Comparative Example 8 are a stainless steel and therefore have excellent corrosion resistance.

The material of Comparative Example 5 is 8Cr steel like the steel for a mold according to the present invention and is not a stainless steel but had high corrosion resistance comparable to that of stainless steel. The reason therefor is considered to be that due to the small C amount, the solid-solution Cr amount is increased.

The material of Comparative Example 6 is 8Cr steel like those of Comparative Example 5 or Examples 1 to 18, but its corrosion resistance was deteriorated. The reason therefor is considered to be that since the C amount is large, Cr is consumed as carbide and the solid-solution Cr amount is reduced.

When the conditions in the above-described test process are applied to the industrial production process of a mold, they correspond to the conditions that (a) a large block produced from a large ingot of 1,000 kg or more is quenched and tempered to thermally refine the block to 37 HRC and (b) a mold is manufactured from the block and polished to a mirror state.

In such mold manufacturing process simulating actual production, the steel for a mold according to the present invention was free from rust even in a high-temperature and humid environment. Consequently, it is determined that in a large pre-hardened steel material for a mold manufactured in actual production, the steel for a mold according to the present invention exerts high corrosion resistance as well.

[3. Summary]

The results of Tables 2 to 7 are shown together in Table 8. In Examples 1 to 18, all of 6 important properties are "S". On the other hand, in Comparative Examples 1 to 8, at least one is "I". In this way, the materials of Examples 1 to 18 were verified to have (1) good SA property, (2) tempering hardness of 32 to 44 HCR, (3) low residual stress, (4) superior machinability, (5) high impact value, and (6) good corrosion resistance.

TABLE 8

| | | SA Property | 555° C. Tempering Hardness | 555° C. Tempering Residual Stress | 37 HRC Machin-ability | 37 HRC Impact Value | 37 HRC Corrosion Resistance |
|---|---|---|---|---|---|---|---|
| Example | 1 | S | S | S | S | S | S |
| | 2 | S | S | S | S | S | S |
| | 3 | S | S | S | S | S | S |
| | 4 | S | S | S | S | S | S |
| | 5 | S | S | S | S | S | S |
| | 6 | S | S | S | S | S | S |
| | 7 | S | S | S | S | S | S |
| | 8 | S | S | S | S | S | S |
| | 9 | S | S | S | S | S | S |
| | 10 | S | S | S | S | S | S |
| | 11 | S | S | S | S | S | S |
| | 12 | S | S | S | S | S | S |
| | 13 | S | S | S | S | S | S |
| | 14 | S | S | S | S | S | S |
| | 15 | S | S | S | S | S | S |
| | 16 | S | S | S | S | S | S |
| | 17 | S | S | S | S | S | S |
| | 18 | S | S | S | S | S | S |
| Comparative Example | 01 | I | S | S | S | I | I |
| | 02 | I | S | S | S | I | I |
| | 03 | I | S | S | S | I | I |
| | 04 | S | S | S | S | S | I |
| | 05 | I | I | S | S | I | S |
| | 06 | S | S | S | S | S | I |
| | 07 | S | S | S | I | I | S |
| | 08 | I | S | S | I | I | S |

[4. Versatility]

In the verification of properties, a bar formed from an ingot was described as an example, but the steel for a mold according to the present invention can also be utilized by forming it into a powder, a block, a wire material, or a plate material.

For example, when the steel for a mold according to the present invention is formed into a powder, the powder can be applied to additive manufacturing (SLM system, LMD system, etc.) or a variety of sequential manufacturing such as plasma overlay welding (PPW).

When the steel for a mold according to the present invention is formed into a block from an ingot, a mold or parts can be manufactured from the block.

When the steel for a mold according to the present invention is formed into a bar or wire material formed from an ingot, the bar or wire material can be applied to sequential manufacturing or repair of overlaying it by means of TIG, laser welding, etc.

Alternatively, it is also possible to form the steel for a mold according to the present invention into a plate material and join a plurality of plate materials to manufacture a mold or parts.

Of course, it is also possible to manufacture split-format molds or parts each composed of the steel for a mold according to the present invention and join these to manufacture a mold or parts.

As described above, the steel for a mold according to the present invention can be applied to various shapes. In addition, a mold or parts can be manufactured or repaired by using materials having various shapes, each composed of the steel for a mold according to the present invention, and various methods.

While the embodiments of the present invention have been described in detail, the present invention is not limited to these embodiments by any means, and various changes and modifications can be made therein without departing from the gist of the present invention.

The present application is based on Japanese Patent Application No. 2020-195052 filed on Nov. 25, 2020, and the contents thereof are incorporated herein by reference.

The steel for a mold according to the present invention can be utilized for a mold or mold parts used in injection molding or blow molding of plastics or resins, in molding of rubber or in molding of fiber-reinforced plastics (e.g., FRP, CFPR, CFRTP, GFRP).

In addition, it is also effective to combine the steel for a mold after thermal refining according to the present invention with surface modification (e.g., shot blasting, sand blasting, nitridation, PVD, PCVD, CVD, plating). The steel for a mold after thermal refining according to the present invention can also be used by providing an uneven pattern on its surface by means of chemical corrosion, machining, laser processing, etc. (called "embossing") and transferring the pattern to a plastic or resin product so as to add value.

Furthermore, the steel for a mold according to the present invention can also be applied to a powder or a plate used in additive manufacturing. The steel for a mold according to the present invention can also be formed into a bar or wire material and used for weld repair of a mold or mold parts.

What is claimed is:

1. A steel for a mold, comprising:
0.070≤C≤0.130 mass %,
0.01≤Si≤0.60 mass %,
0.02≤Mn≤0.60 mass %,
0.003≤P≤0.150 mass %,
0.005≤Cu≤0.21 mass %,
0.005≤Ni≤0.80 mass %,
7.50≤Cr≤8.40 mass %,
0.80≤Mo≤1.20 mass %,
0.01≤V≤0.30 mass %,
0.025≤Al≤0.091 mass %, and
0.027≤N≤0.095 mass %,
with the balance being Fe and unavoidable impurities, and
wherein the steel has a hardness measured in a temperature range of 15° C. or more and 35° C. or less of 32 HRC or more and 44 HRC or less, and
an average absorbed energy measured in a temperature range of 15° C. or more and 35° C. or less of 20 J or more.

2. The steel for a mold according to claim 1, further comprising
at least one element selected from the group consisting of:
0.30<W≤4.00 mass %, and
0.30<Co≤3.00 mass %.

3. The steel for a mold according to claim 1, further comprising:
0.0002<B≤0.0080 mass %.

4. The steel for a mold according to claim 2, further comprising:
0.0002<B≤0.0080 mass %.

5. The steel for a mold according to claim 1, further comprising
at least one element selected from the group consisting of:
0.004<Nb≤0.100 mass %,
0.004<Ta≤0.100 mass %,
0.004<Ti≤0.100 mass %, and
0.004<Zr≤0.100 mass %.

6. The steel for a mold according to claim 2, further comprising
at least one element selected from the group consisting of:
0.004<Nb≤0.100 mass %,
0.004<Ta≤0.100 mass %,
0.004<Ti≤0.100 mass %, and
0.004<Zr≤0.100 mass %.

7. The steel for a mold according to claim 3, further comprising
at least one element selected from the group consisting of:
0.004<Nb≤0.100 mass %,
0.004<Ta≤0.100 mass %,
0.004<Ti≤0.100 mass %, and
0.004<Zr≤0.100 mass %.

8. The steel for a mold according to claim 4, further comprising
at least one element selected from the group consisting of:
0.004<Nb≤0.100 mass %,
0.004<Ta≤0.100 mass %,
0.004<Ti≤0.100 mass %, and
0.004<Zr≤0.100 mass %.

9. The steel for a mold according to claim 1, further comprising
at least one element selected from the group consisting of:
0.003<S≤0.250 mass %,
0.0005<Ca≤0.2000 mass %,
0.03<Se≤0.50 mass %,
0.005<Te≤0.100 mass %,
0.01<Bi≤0.50 mass %, and
0.03<Pb≤0.50 mass %.

10. The steel for a mold according to claim 2, further comprising
at least one element selected from the group consisting of:
0.003<S≤0.250 mass %,
0.0005<Ca≤0.2000 mass %,
0.03<Se≤0.50 mass %,
0.005<Te≤0.100 mass %,
0.01<Bi≤0.50 mass %, and
0.03<Pb≤0.50 mass %.

11. The steel for a mold according to claim 3, further comprising
at least one element selected from the group consisting of:
0.003<S≤0.250 mass %,
0.0005<Ca≤0.2000 mass %,
0.03<Se≤0.50 mass %,
0.005<Te≤0.100 mass %,
0.01<Bi≤0.50 mass %, and
0.03<Pb≤0.50 mass %.

12. The steel for a mold according to claim 4, further comprising
at least one element selected from the group consisting of:
0.003<S≤0.250 mass %,
0.0005<Ca≤0.2000 mass %,
0.03<Se≤0.50 mass %,
0.005<Te≤0.100 mass %,
0.01<Bi≤0.50 mass %, and
0.03<Pb≤0.50 mass %.

13. The steel for a mold according to claim 5, further comprising
at least one element selected from the group consisting of:
0.003<S≤0.250 mass %,
0.0005<Ca≤0.2000 mass %,
0.03<Se≤0.50 mass %,
0.005<Te≤0.100 mass %,
0.01<Bi≤0.50 mass %, and
0.03<Pb≤0.50 mass %.

14. The steel for a mold according to claim 6, further comprising
at least one element selected from the group consisting of:
0.003<S≤0.250 mass %,
0.0005<Ca≤0.2000 mass %,
0.03<Se≤0.50 mass %,
0.005<Te≤0.100 mass %,
0.01<Bi≤0.50 mass %, and
0.03<Pb≤0.50 mass %.

15. The steel for a mold according to claim 7, further comprising
at least one element selected from the group consisting of:
0.003<S≤0.250 mass %,
0.0005<Ca≤0.2000 mass %,
0.03<Se≤0.50 mass %, $0.005<Te\leq0.100$ mass %, $0.01<Bi\leq0.50$ mass %, and $0.03<Pb\leq0.50$ mass %.

16. The steel for a mold according to claim 8, further comprising at least one element selected from the group consisting of:

$0.003<S\leq0.250$ mass %, $0.0005<Ca\leq0.2000$ mass %, $0.03<Se\leq0.50$ mass %, $0.005<Te\leq0.100$ mass %, $0.01<Bi\leq0.50$ mass %, and $0.03<Pb\leq0.50$ mass %.

17. The steel for a mold according to claim 1, further comprising $0.87\leq Mo\leq1.20$ mass %.

18. The steel for a mold according to claim 1, further comprising $0.91\leq Mo\leq1.20$ mass %.

* * * * *